US009103604B2

(12) United States Patent
Denoual

(10) Patent No.: US 9,103,604 B2
(45) Date of Patent: Aug. 11, 2015

(54) HEAT EXCHANGE UNIT AND CORRESPONDING HEAT EXCHANGER, METHOD OF MANUFACTURING A HEAT EXCHANGE UNIT

(75) Inventor: Christophe Denoual, Noyen sur Sarthe (FR)

(73) Assignee: VALEO SYSTEMES THERMIQUES, Le Mesnil Saint Denis, Cedex (FR)

( * ) Notice: Subject to any disclaimer, the term of this patent is extended or adjusted under 35 U.S.C. 154(b) by 250 days.

(21) Appl. No.: 12/791,315

(22) Filed: Jun. 1, 2010

(65) Prior Publication Data

US 2010/0300665 A1 Dec. 2, 2010

(30) Foreign Application Priority Data

Jun. 2, 2009 (FR) ..... 09 02628

(51) Int. Cl.

| | |
|---|---|
| ***B21C 37/30*** | (2006.01) |
| ***F28D 7/10*** | (2006.01) |
| ***F28F 9/02*** | (2006.01) |

(Continued)

(52) U.S. Cl.

CPC . *F28F 9/02* (2013.01); *F25B 40/00* (2013.01); *F28D 7/0025* (2013.01); *F28D 7/106* (2013.01); *F28F 1/022* (2013.01); *F28F 1/04* (2013.01); *F28F 3/048* (2013.01); *F28F 2255/08* (2013.01); *F28F 2255/16* (2013.01); *Y10T 29/4935* (2015.01)

(58) Field of Classification Search

CPC ..... B21C 37/151; B21C 37/30; F28F 1/022; F28D 7/10

USPC ..... 165/154, 140, 141, 164; 29/890.053

See application file for complete search history.

(56) References Cited

U.S. PATENT DOCUMENTS

| | | | | |
|---|---|---|---|---|
| 349,060 | A * | 9/1886 | Serve | 165/179 |
| 813,918 | A * | 2/1906 | Schmitz | 165/154 |

(Continued)

FOREIGN PATENT DOCUMENTS

| | | | |
|---|---|---|---|
| EP | 1739375 | A1 | 1/2007 |
| JP | 05010694 | A * | 1/1993 |

(Continued)

OTHER PUBLICATIONS

English language abstract for EP1739375 extracted from espacenet.com database, dated Sep. 17, 2010, 18 pages.

(Continued)

*Primary Examiner* — Leonard R Leo

(74) *Attorney, Agent, or Firm* — Howard & Howard Attorneys PLLC

(57) ABSTRACT

The invention relates to a heat exchange unit between a first and a second fluid with the heat exchange unit comprising:

Figure 5B:
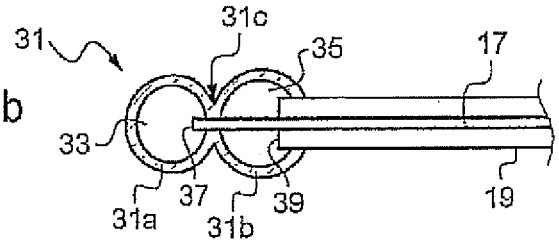

- at least one interior duct (17) having a plurality of first longitudinal internal channels (21) for the circulation of the first fluid,
- a hollow exterior envelope (19) wherein is housed the interior duct (17), and
- at least two ribbed walls (19*a*) arranged on either side of the interior duct (17), in contact with the interior duct (17) and as well with the exterior envelope (19), in such a way as to delimit a plurality of second longitudinal channels (29) for the circulation of the second fluid, the second channels (29) extending substantially in parallel to the first channels (21). The invention also relates to a heat exchanger incorporating a heat exchange unit as well as a method of manufacturing such a unit.

21 Claims, 2 Drawing Sheets

(51) Int. Cl.

| | |
|---|---|
| ***F25B 40/00*** | (2006.01) |
| ***F28D 7/00*** | (2006.01) |
| ***F28F 1/02*** | (2006.01) |
| ***F28F 1/04*** | (2006.01) |
| ***F28F 3/04*** | (2006.01) |

(56) References Cited

U.S. PATENT DOCUMENTS

| | | | | |
|---|---|---|---|---|
| 1,689,461 | A * | 10/1928 | Taylor et al. | 165/154 |
| 2,259,433 | A * | 10/1941 | Kitto | 165/154 |
| 3,453,840 | A * | 7/1969 | Nagakura et al. | 165/154 |
| 5,242,015 | A * | 9/1993 | Saperstein et al. | 165/164 |
| 6,386,277 | B1 * | 5/2002 | Wattelet et al. | 165/164 |
| 2003/0066636 | A1 | 4/2003 | Kawakubo et al. | |

FOREIGN PATENT DOCUMENTS

| | | | |
|---|---|---|---|
| JP | 10267585 | A | 10/1998 |
| JP | 2000346584 | A | 12/2000 |
| WO | WO 2005033603 | A2 | 4/2005 |

OTHER PUBLICATIONS

English language translation and abstract for JP 10-267585 extracted from PAJ database, dated Sep. 17, 2010, 26 pages.

English language translation and abstract for JP 2000-346584 extracted from PAJ database, dated Sep. 17, 2010, 28 pages.

English language abstract for WO 2005-033603 extracted from espacenet.com database, dated Sep. 17, 2010, 22 pages.

INPI Institut National De La Propriete Industrielle Search Report for FA724102/FR0902628, dated Jan. 20, 2010, 1 page.

* cited by examiner

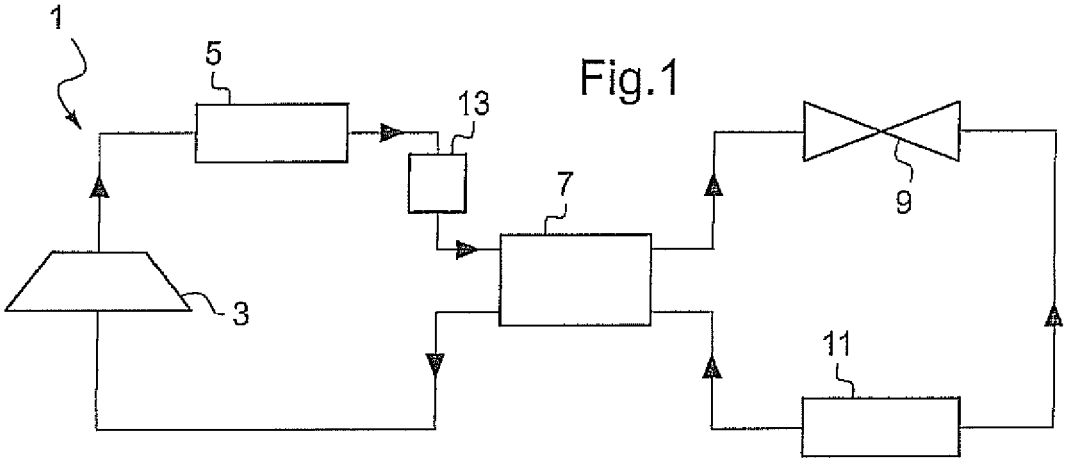
Fig.1
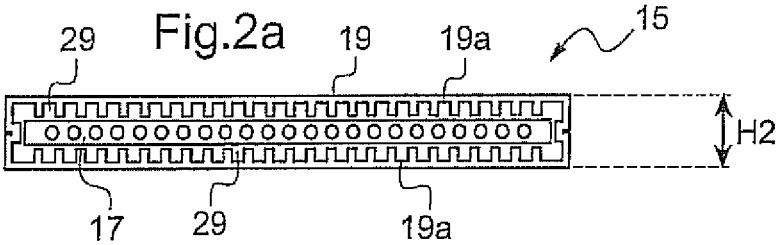
Fig.2a
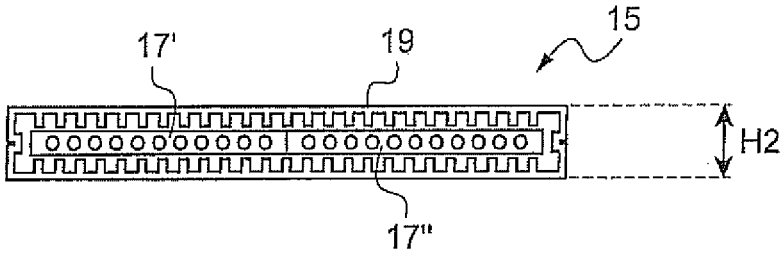
Fig.2b
Fig.3
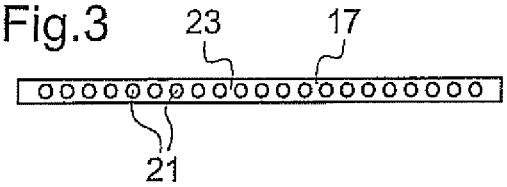
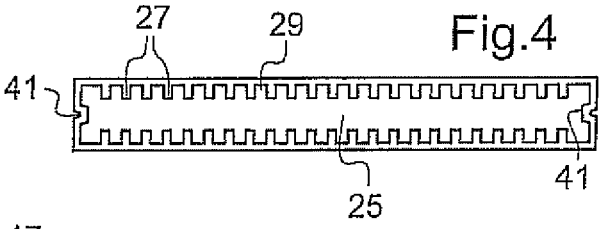
Fig.4
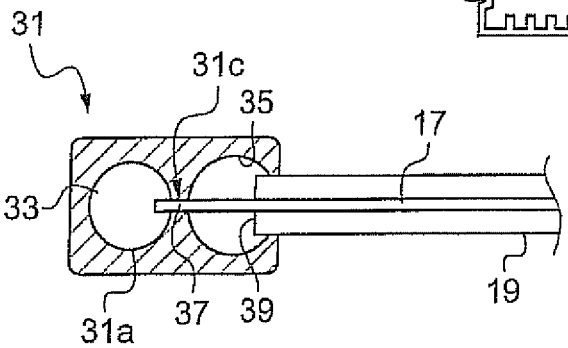
Fig.5a

HEAT EXCHANGE UNIT AND CORRESPONDING HEAT EXCHANGER, METHOD OF MANUFACTURING A HEAT EXCHANGE UNIT

RELATED APPLICATIONS

This application claims priority to and all the advantages of French Patent Application No. FR 09/02628, filed on Jun. 2, 2010.

The invention relates to a heat exchange unit and a corresponding heat exchanger comprising such a heat exchange unit. The invention also relates to a method of manufacturing a heat exchange unit.

The invention has a particularly advantageous application in the field of heat exchangers in automotive vehicles, in particular internal exchangers in air conditioning cycles wherein the coolant at high pressure and high temperature exchanges with the same refrigerating fluid at low pressure and at low temperature.

Heat exchangers are known for automotive vehicles constituted by a cluster of tubes arranged in parallel on one or several rows, these tubes being intended for the circulation of a coolant through the exchanger.

In a known manner, the tubes used are brazed on heat exchanging elements constituted of inserts placed between the tubes. In general, these inserts are carried out in the form of rippled surfaces, the tubes being brazed on the inserts on crests of ripples.

US2003/0066636A1 discloses a tube for heat exchanger comprising a plurality of passages aligned in two parallel rows. This tube is implemented by a method of extruding during which the two rows of passages are carried out simultaneously.

However such a technique is lacking in flexibility since the two rows are manufactured simultaneously. Moreover, such a tube does not optimize the heat exchanges between rows of passages. Finally, the assembly of the manifold block at the end of the tube is made complicated by the simultaneous constitution of the two rows of passages. This results in that the assembly of all of the tubes is long and expensive, and impacts the assembling and the cost of the heat exchanger.

The invention thus has for purpose to propose a simplified assembly of a heat exchange unit for heat exchanger at least cost.

To this effect, the invention has for object a heat exchange unit between a first and a second fluid characterized in that it comprises:

- at least one interior duct having a plurality of first longitudinal internal channels for the circulation of the first fluid,
- a hollow exterior envelope wherein is housed said interior duct, and
- at least two ribbed walls arranged on either side of said interior duct, in contact with said interior duct as well as with said exterior envelope, in such a way as to delimit a plurality of second longitudinal channels for the circulation of the second fluid, said second channels extending substantially in parallel to said first channels.

Such a unit can be manufactured and assembled easily while still offering qualities of optimum heat transfer, by the points of contact between the internal tube and the external tube but also by the fact that the first fluid is sandwiched between two layers of the first fluid as well. The exchange surface is as such easily increased.

Advantageously, said interior duct is carried out in the form of a plate and said exterior envelope has a general hollow parallelepiped form, the exterior envelope having two lateral walls which extend between the ribbed walls.

Further advantageously, the interior duct is an extruded duct. The exterior envelope delimits a duct also carried out by extrusion. This provides a high resistance to the pressure required for the use of such a unit with a super-critical refrigerating fluid of the carbon dioxide type wherein the bursting pressures can reach 200 to 300 bars.

Alternatively, the exterior envelope is manufactured using a strip, for example for the air conditioning loop with lesser compression stresses.

According to a first alternative, at least one of the ribbed walls has at least one rib in contact with the interior duct by the intermediary of a flat end of the rib. Good adherence is as such provided thanks to a contact surface that is sufficient between the flat end and the external wall of the interior duct.

The lateral walls having a local deformation, i.e. an indentation curved towards the interior of the exterior envelope. This characteristic facilitates a step of compressing of the exterior envelope. The indentation thus has a "V"-shaped section before the step of compressing of the exterior envelope, then a "U"-shaped form of which the branches touch after said step of compressing.

The invention also relates to a heat exchanger comprising at least one heat exchange unit such as defined hereinabove.

Said exchanger comprises at least one introduction manifold block and at least one evacuation manifold block of fluid, said manifold blocks comprising respectively:

- a first collector associated to the first fluid and connected to an associated end of said interior duct, and
- a second collector associated to the second fluid and connected to an associated end of said exterior envelope, said collectors being separated in a sealed manner.

Advantageously, said manifold block has in the transversal section a substantially "eight" general form, of which the first and second loops delimit respectively the first and second collector, and of which the portion that is common to the two boucles has an opening for the passage of an associated end.

Alternatively, the heat exchanger comprises at least one introduction manifold block and at least one evacuation manifold block of fluid, said manifold blocks comprising respectively a single collector connected to an associated end of said interior duct for the introduction and the evacuation of the first fluid.

The associated ends of said interior duct protrude from either side of said exterior envelope.

Finally, the invention covers a method of manufacturing a heat exchange unit between a first and a second fluid, characterized in that it comprises the following steps:

A) in a hollow exterior envelope is arranged at least one interior duct having a plurality of first internal parallel longitudinal channels for the circulation of the first fluid, with at least two ribbed walls on either side of the longitudinal external surfaces of said interior duct, and B) said exterior envelope is compressed in order to reduce the volume of said envelope until said ribbed walls are in contact with said interior duct as well as with said exterior envelope, in such a way as to delimit a plurality of second longitudinal channels for the circulation of the second fluid, said second channels extending substantially in parallel to said first channels.

In this method, said ribbed walls are formed on the internal surface of said exterior envelope by means of ribs. Alternatively, said ribbed walls are formed on the external surface of said interior duct by means of ribs.

Advantageously, the interior duct is carried out beforehand by a step of extruding.

The exterior envelope and the ribbed walls are carried out beforehand by a common step of extruding.

Alternatively, said ribbed walls or ribs are formed by folding of a metal strip.

The method of manufacturing comprises a step wherein the internal surface of said exterior envelope is fixed by gluing or brazing to the external surface of said interior duct, in order to optimize the adherence.

According to an alternative, an indentation curved towards the interior of said exterior envelope is carried out, substantially in the middle of the lateral walls of the exterior envelope, in order to facilitate the step B) of compressing the exterior envelope.

Such a method makes it possible to obtain a single heat exchange unit with several circulation channels instead of several tubes to be assembled together, which makes it possible to reduce the number of components to be assembled in a heat exchanger and reduces the risks of leaks.

Furthermore, the arrangement of the circulation channels makes it possible to improve the heat exchange between the two fluids.

Figure 5C:
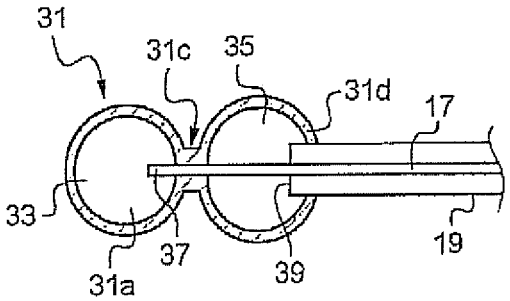
Figure 6A:
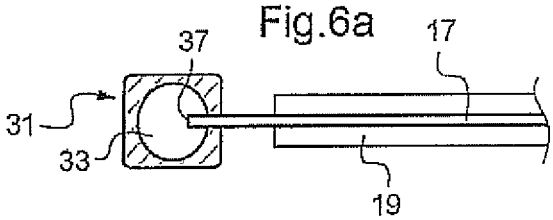
Figure 6B:
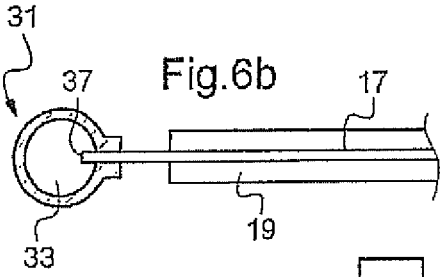
Figure 7:
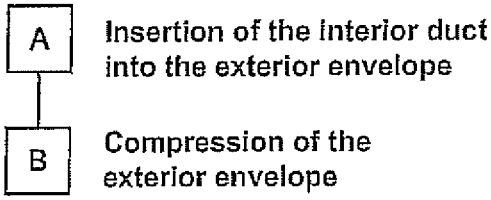
Figure 8:
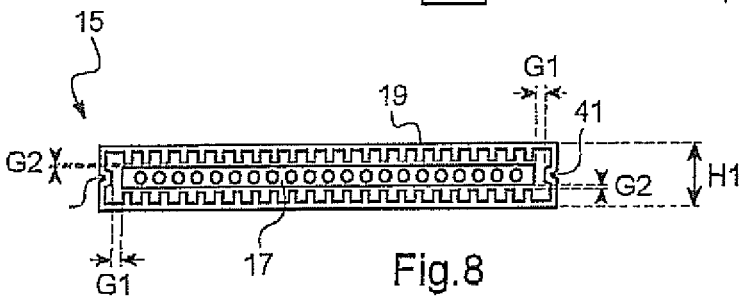

Other characteristics and advantages of the invention emerge from the following description, provided by way of example, without a restrictive nature, with regards to the annexed drawings wherein:

FIG. 1 is a diagram showing a conventional air conditioning circuit,

FIG. 2*a* shows a transversal cross-section view of a heat exchange unit according to a first embodiment, FIG. 2*b* shows a transversal cross-section view of a heat exchange unit according to a second embodiment, FIG. 3 shows an interior duct of the heat exchange unit in FIG. 2*a*, FIG. 4 shows an exterior envelope of the heat exchange unit in FIG. 2*a*, FIGS. 5*a* to 5*c* partially show the heat exchange unit in FIG. 2*a* connected to a manifold block according to a first embodiment, FIGS. 6*a* and 6*b* partially show the heat exchange unit in FIG. 2*a* connected to a manifold block according to a second embodiment, FIG. 7 shows the successive steps of a method of manufacturing the unit in FIG. 2*a*, and FIG. 8 shows the heat exchange unit in FIG. 2*a* during a step of the method in FIG. 7.

In these figures, the substantially identical elements carry the same references.

The invention relates to a heat exchange unit between a first and a second fluid intended to be used in particular in an internal heat exchanger for example in an air conditioning circuit of an automotive vehicle.

An internal exchanger is a device that allows the refrigerating fluid to exchange heat with this same fluid, but in a different state of temperature and of pressure.

The refrigerating fluid is typically a chlorinated and fluorinated fluid operating in a sub-critical speed, such as the fluid R-134a. Nevertheless, the refrigerating fluid can also be a supercritical fluid as for example carbon dioxide known under the reference R744.

An air conditioning circuit 1 such as is shown in the FIG. 1, typically comprises, in the direction of the circulation of the refrigerating fluid, a compressor 3, a condenser or gas cooler 5, an internal exchanger 7, an expansion member, calibrated orifice or expansion device 9, an evaporator 11 and an accumulator or drying bottle 13, these various elements being connected to each other by parts for connection, such as tubes, tubing, pipes or analogous members, in such a way as to provide a circulation of refrigerating fluid.

In FIG. 1, arrows show the circulation of the refrigerating fluid.

The refrigerating fluid, sent by the compressor 3, crosses the condenser 5, from which it exists in a state of high pressure and of high temperature. The refrigerating fluid then crosses the internal exchanger 7, then is expanded in the expansion device 9. The fluid expanded as such is then carried towards the evaporator 11, before joining the internal exchanger 7 in a state of low pressure and of low temperature, which it crosses. The drying bottle 13 can be inserted between the condenser 5 and the internal exchanger 7.

The internal heat exchanger 7 is arranged in such a way that it is crossed in one direction by the coolant at high pressure and high temperature (first fluid) and in the other direction by coolant at low pressure and low temperature (second fluid). This is a single and same fluid since the air conditioning circuit 1 is a closed loop. As such, the hot fluid at high pressure coming from condenser 5 exchanges heat with this same cold fluid at low pressure coming from the evaporator 11. In other words, the internal exchanger 7 provides a heat exchange of the refrigerating fluid at two different points of the air conditioning circuit.

At the output of the exchanger 7, the fluid again reaches the compressor 3, and continues as such.

Such an exchanger 7 can include one or several heat exchange units 15 such as shown in FIG. 2*a*.

The heat exchange unit 15 comprises:

an interior duct 17, a hollow exterior envelope 19 forming a housing for the interior duct 17, and at least two ribbed walls 19*a* on either side of the interior duct 17. The wall 19*a* is considered to be ribbed when it comprises at least one protuberance or rib 27 which establishes a mechanical relation between the exterior envelope 19 and the interior duct 17.

Alternatively, an exchange unit 15 can be provided with several interior ducts inserted into a common exterior envelope 19. An alternative embodiment with two interior ducts 17' and 17" in the same envelope 19 is shown in the FIG. 2*b*.

In the example shown in the FIG. 2*a*, the interior duct 17 is carried out in the form of a plate of which the external surface is substantially smooth.

The interior duct 17 (FIG. 3) comprises a plurality of first longitudinal channels 21 for the circulation of the first fluid, for example according to a substantially cylindrical form. These channels 21 are parallel in relation to one another and are separated by longitudinal partitions 23 of the interior duct 17.

This interior duct 17 has thin walls, which makes it possible to limit the weight of the heat exchange unit 15 and to improve the heat exchanges.

Furthermore, the carrying out of a single duct 17 with several channels 21 of fluid circulation makes it possible to reduce the number of components in relation to several tubes or plates respectively delimiting a single channel of fluid circulation, which facilitates the assembly. The interior duct 17 is as such carried out by a method of extruding of aluminum or an aluminum alloy.

The exterior envelope 19, which can be seen better in FIG. 4, has for example a general hollow parallelepiped form, and comprises an orifice 25 for the insertion of the interior duct 17. The exterior envelope 19 comprises in practice four so-called ribbed internal walls at the base of which the ribs 27 extend in the direction of the interior duct 17.

As can be observed in FIGS. 2*a* and 4, the longitudinal internal surfaces of the exterior envelope 19 are the ribbed walls 19*a*of which the plurality of ribs 27 are terminated with a flat end which adhere to the surface or external wall of the interior duct 17, in such a way as to delimit a plurality of second longitudinal channels 29 for the circulation of the second fluid. These second channels 29 extend substantially in parallel to the first channels 21 between the interior duct 17 and the exterior envelope 19.

The second fluid crossing the second channels 29 of circulation are in direct contact with the interior duct 17, which optimizes the heat exchange with the first fluid.

The exterior envelope 19 also has thin walls, by way of example of a magnitude of 0.2 mm to 0.5 mm, in order to limit the weight of the heat exchange unit and improve the heat exchanges.

The exterior envelope 19 moreover has a local deformation of the lateral internal walls of the exterior envelope 19 substantially in the middle of said lateral walls.

In the example shown, the local deformation of the exterior envelope 19 is formed by an indentation 41 curved towards the interior of the exterior envelope 19. This indentation 41 curved towards the interior of the exterior envelope 19 is present on the lateral walls of the exterior envelope 19 which extend between the ribbed walls 19*a*. The indentations 41 thus form a fold over the entire length of the exterior envelope 19. The function of these indentations is to facilitate the step of compressing (detailed hereinafter) in order to reduce the internal volume of the exterior envelope 19 in such a way as to place it into contact with the external or peripheral walls of the interior duct 17.

The exterior envelope 19 is carried out in aluminum and in the mass for example by means of a method via extrusion.

Alternatively, the exterior envelope 19 is carried out by stamping using a strip of aluminum. In this case, one of the two indentations 41 is cut along the length in such a way as to separate the two ribbed walls 19*a*. The other indentation 41 is then used as a hinge to fold back the first ribbed wall 19*a* onto the second opposite ribbed wall and as such sandwich the interior duct 17.

According to an alternative, an internal surface of the exterior smooth envelope 19 and ribbed walls can be provided formed on the external surface of the interior duct 17, in order to delimit the second channels 29. This alternative is particularly dedicated for the manufacture of an exterior envelope 19 using a strip of aluminum (or aluminum alloy) as mentioned hereinabove.

According to another alternative, it can be provided to form these ribbed walls by separate parts before brazing, for example by folding of a metal strip. This alternative makes it possible to simplify the carrying out of the exterior envelope and of the interior duct.

Such a heat exchange unit can therefore be easily assembled in a heat exchanger which thus has a reduced number of components.

FIGS. 5*a* to 6*b* diagrammatically show a heat exchange unit such as described hereinabove connected to a manifold block for example of the internal exchanger 7. In these figures, the portion shown on the left comprises a symmetrical portion not shown on the right.

This exchanger 7 can include at least two manifold blocks 31, one for the introduction of the fluid and one for the evacuation of the fluid. These manifold blocks 31 can be carried out using a metal material such as aluminum or an aluminum alloy, or plastic.

A first embodiment showing a closed circuit for the fluids is shown in the FIGS. 5*a* to 5*c*.

According to this first embodiment, a manifold block 31 comprises:

a first collector 33 for the introduction or the evacuation of the first fluid, and a second collector 35 for the introduction or the evacuation of the second fluid.

These collectors 33 and 35 are separated in a sealed manner and delimit respectively chambers that communicate with the associated ends 37 of the interior duct 17 and 39 of the exterior envelope 19. The internal volume of these collectors 33 and 35 are respectively in communication with the first channels 21 and the second channels 29.

The two collectors 33 and 35 can be arranged side by side, for example with the first collector 33 upstream of the second collector 35.

Different forms of carrying out the two collectors can be provided, as shown in FIGS. 5*a* to 5*c*.

For example in FIG. 5*a*, the manifold block 31 has a substantially parallelepiped general form and two collectors 33,35 with a substantially cylindrical general section formed example via extrusion.

In FIG. 5*b*, the two collectors 33 and 35 are formed by two side-by-side cylinders and in FIG. 5*c* by two spaced cylinders.

Each collector 33, 35 comprises an opening of a form that is complementary to the form of the ends 37 or 39, here of substantially rectangular general section, for the reception of the associated ends 37 of the interior duct 17 and 39 of the exterior envelope 19.

As such, a manifold block 31 has in transversal section a substantially "eight" general form, of which the first 31*a* delimits the first collector 33 and the second 31*b* loop delimits the second collector 35.

Furthermore, as can be observed in FIGS. 5*a* to 5*c*, the portion 31*c* that is common to the two boucles 31*a*, 31*b* of the "eight" has an opening for the passage of an associated end 37, 39. In the example shown, it is the end 37 of the interior duct 17 which crosses the second collector 35 in order to be connected to the first collector 33.

To this effect, the end 37 of the interior duct 17 protrudes in relation to the end 39 of the exterior envelope 19. This makes it possible to simply and independently connect, the various ends 37 of the interior duct 17 and 39 of the exterior envelope 19, respectively to the first 17 and second 19 collectors.

As the missing portion is symmetrical, it is understood that the two associated ends 35 of the interior duct 17 protrude on either side of the exterior envelope 19.

According to an alternative not shown, it can be provided that the two collectors 33 and 35 be imbricated one in the other.

Moreover, a solder plate can be provided on the ends 37 and 39 for a fastening via brazing to the collectors 33 and 35.

Alternatively, the second embodiment shown in the FIGS. 6*a* and 6*b*, shows a closed circuit for the first fluid and open for the second fluid.

According to this second embodiment, the manifold blocks 31 comprise respectively a single collector 33 to which is fixed the associated end 37 of the interior duct 17 for the introduction and the evacuation of the first fluid.

Furthermore, in a known manner, the collectors comprise respectively at their ends tubings for introducing and evacuating fluid.

Referring to FIG. 7, the successive steps for the carrying out of such an exchange unit 15 shall now be described.

Beforehand, the material used as a base for the carrying out of an interior duct 17 is chosen, for example aluminum or an aluminum alloy.

The interior duct 17 is carried out during a preliminary step. An extrusion can be made for example in order to form the first channels 21 of circulation of the first fluid (see FIG. 3).

Likewise, the material used as a base to carry out an exterior envelope 19 is chosen, for example aluminum or aluminum alloy, then the exterior envelope 19 is carried out in the form of a duct carried out via extrusion. Then for example by extrusion is carried out an internal orifice 25 in the envelope 19. Alternatively, the exterior envelope 19 is carried out using a strip that is folded substantially at its centre, the location of one of the indentations 41. The orifice 25 is as such recreated. In this alternative with strip, the interior duct 17 can be introduced laterally, i.e. according to a perpendicular displacement of the internal duct 17 in relation to the indentation 41 remaining open.

In an alternative wherein the exterior envelope 19 is carried out by extrusion, the orifice 25 is intended to receive the interior duct 17 and has for this purpose a form that is complementary to the form of the interior duct 17.

Then, for example a plurality of ribs 27 are formed on the longitudinal internal walls 19*a* of the exterior envelope 19, (see FIG. 4). Advantageously, these ribs 27 are carried out at the same time as the exterior envelope 19 during the step of extruding.

During a first step A, the interior duct 17 is inserted into the orifice 25 (FIG. 8). In the example shown, the interior duct 17 is inserted into the exterior envelope 19 according to an axis of insertion parallel to the first 21 and second 29 channels, in such a way that the longitudinal walls of the interior duct 17 and of the exterior envelope 19 extend in parallel.

As can be observed in FIG. 8, a first spacing G2 is present between the longitudinal external walls of the interior duct 17 and the ends of the ribs 27 present on the longitudinal internal walls 19*a* of the exterior envelope 19. Likewise, a second spacing G1 is present, between the external lateral walls of the interior duct 17 and the internal surface of the indentations 41 of the exterior envelope 19. The presence of these first G2 and second G1 spacings makes it possible to easily insert the interior duct 17 into the exterior envelope 19. These first G2 and second G1 spacings are between 0.05 mm and 0.3 mm.

Furthermore, the arrangement of the channels 21 and of the ribs 27 parallel to the longitudinal directions makes possible a parallel circulation of the first and second fluids, co-current or counter-current.

Finally, during a second step B, the exterior envelope 19 is compressed, for example by pressing or rolling, in such a way that the volume of the exterior envelope 19 is reduced.

Indeed, it is observed that before compression the exterior envelope 19 has a first height H1, and after compression (see FIG. 2*a* or 2*b*) the exterior envelope 19 has a second height H2 that is reduced in relation to the first height H1.

The indentations 41 have a "V"-shaped section before the step of pressing or rolling although they have a "U"-shaped section wherein the branches touch after pressing or rolling.

The heat exchange unit as such has a reduced size which makes it possible to decrease the size of the heat exchanger.

Furthermore, subsequent to this compression of the exterior envelope 19, the internal walls 19*a* of the exterior envelope 19 adhere to the external walls of the interior duct 17 in order to optimize the heat exchange. The end plates 50 of the ribs 27 are as such perfectly thrust against the external wall of the interior duct thus delimiting each second canal 29.

As such, during the second step of compressing B, the lateral walls of the exterior envelope 19 having this indentation 41, are deformed towards the interior in such a way as to come into contact with the interior duct 17 (see FIG. 8), which makes possible the adherence between the internal surface of the exterior envelope 19 and the external surface of the interior duct 17 via the end plates of the ribs 27 and/or via the end of the indentations 41.

No deformation is then visible on the exterior envelope 19 once the whole is compressed. The lateral walls of the envelope 19 therefore have smooth surfaces except for the edge for connection of the two branches of the "U" of the indentation 41 (FIGS. 2*a*, 2*b*).

Moreover and after the step of compressing B, and this in order to optimize the adherence and the seal between the interior duct 17 and the exterior envelope 19, a step is provided wherein, for example by brazing or collage, the internal walls 19*a*, 19*b*of the exterior envelope 19 are fastened to the external walls 17*a*, 17*b*of the interior duct 17. The lateral walls can also be welded or brazed on the interior duct 17.

The heat exchange unit 15 carried out as such makes it possible to optimize the heat exchange between the two fluids.

One or several heat exchange units 15 can then be assembled to the manifold blocks, in order to assemble a heat exchanger.

All of the heat exchanger can then pass in an appropriate brazing furnace, in order to braze in one operation the various parts to be fixed, such as the ends 37 and 39 of the interior duct 17 and of the exterior envelope 19 with the manifold blocks 33, 35 or the external surface of the interior duct 17 with the internal surface of the exterior envelope 19.

It is therefore understood that such a heat exchange unit 15 can be carried out simply and easily connected to the manifold blocks 33, 35 which makes it possible to optimize the temps and the cost of assembly of a heat exchanger.

The invention claimed is:

1. A method of manufacturing a heat exchange unit between a first and a second fluid, said method comprising the following steps:

in a hollow exterior envelope (19) is arranged at least one interior duct (17) having a plurality of exterior walls and a plurality of first internal parallel longitudinal channels (21) for the circulation of the first fluid, with at least two ribbed walls (19*a*) on either side of the longitudinal external surfaces of the interior duct (17), the exterior envelope having a parallelepiped form and two lateral walls with a first height;

forming an indentation in the lateral walls of the exterior envelope, substantially in the middle of the lateral walls of the exterior envelope, such that the interior duct has lateral external ends spaced laterally from lateral internal ends of the indentation when housed in the exterior envelope;

compressing the exterior envelope (19) against the interior duct to reduce the volume of the envelope (19) until the ribbed walls (19*a*) are in contact with the interior duct (17) as well as with the exterior envelope (19) and the lateral walls have a second height less than the first height to delimit a plurality of second longitudinal channels (29) for the circulation of the second fluid, the second channels (29) extending substantially in parallel to the first channels (21); and fastening only the ribbed walls of the exterior envelope to the exterior walls of the interior duct.

2. A method of manufacturing according to claim 1, characterized in that the ribbed walls (19*a*) are formed on an internal surface of the exterior envelope (19) by at least one rib (27).

3. A method of manufacturing according to claim 1, characterized in that the ribbed walls (19*a*) are formed on an external surface of the interior duct (17) by at least one rib (27).

4. A method of manufacturing according to claim 1, wherein the interior duct (17) is formed by extruding.

5. A method of manufacturing according to claim 1, wherein the exterior envelope (19) and the ribbed walls (19*a*) are formed via a common step of extruding.

6. A method of manufacturing according to claim 1, characterized in that the ribbed walls (19*a*) are formed by folding of a metal strip.

7. A method of manufacturing according to claim 1, comprising a step wherein an internal surface of the exterior envelope (19) is fixed by gluing or brazing to an external surface of the interior duct (17).

8. A method of manufacturing according to claim 1, comprising a step of forming an indentation (41) curved towards an interior of the exterior envelope (19), substantially in the middle of the lateral walls (51) of the exterior envelope (19), to facilitate said step B) of compressing the exterior envelope (19).

9. A heat exchange unit between a first fluid and a second fluid comprising:

at least one interior duct (17) having a plurality of exterior walls and a plurality of first longitudinal internal channels (21) for the circulation of the first fluid, said interior duct (17) being in the form of a plate;

a hollow exterior envelope (19) being separate from said interior duct (17) and wherein is housed said interior duct (17), said exterior envelope (19) having a parallelepiped form and two lateral walls with a first height (H1); and at least two ribbed walls (19*a*) arranged on either side of said interior duct (17), in contact with said interior duct (17) as well as with said exterior envelope (19), in such a way as to delimit a plurality of second longitudinal channels (29) for the circulation of the second fluid, said second channels (29) extending substantially in parallel to said first channels (21);

wherein said lateral walls have a local deformation formed by an indentation (41) that extends between said ribbed walls (19*a*) and toward the interior of the exterior envelope, said interior duct (17) has lateral external ends spaced laterally from lateral internal ends of said indentation (41) when housed in said exterior envelope (19), said indentation (41) forms a fold over an entire length of said exterior envelope (19) that facilitates compression of said exterior envelope (19) against said interior duct (17), and wherein said indentation (41) has a U-shaped form with two branches extending therefrom such that said two branches are in contact after compression and said lateral walls have a second height (H2) less than said first height (H1); and only said ribbed walls of said exterior envelope (19) being fastened to said exterior walls of said interior duct (17).

10. A heat exchange unit according to claim 9, wherein said interior duct (17) is an extruded duct.

11. A heat exchange unit according to claim 9, wherein said exterior envelope (19) delimits a duct carried out by extrusion.

12. A heat exchange unit according to claim 9, wherein said exterior envelope (19) is manufactured using a strip.

13. A heat exchange unit according to claim 9, wherein at least one of said ribbed walls (19*a*) has at least one rib (27) in contact with said interior duct (17) by the intermediary of a flat end of said rib (27).

14. A heat exchange unit according to claim 9, wherein said local deformation is an indentation (41) curved towards an interior of said exterior envelope (19).

15. A heat exchange unit according to claim 14, wherein said indentation (41) has a "V"-shaped section formed before a step of compressing of said exterior envelope (19).

16. A heat exchanger comprising at least one heat exchange unit according to claim 9.

17. A heat exchanger according to claim 16, comprising at least one introduction manifold block (31) and at least one evacuation manifold block (31) of fluid, said manifold blocks (31) comprising respectively:

a first collector (33) associated to the first fluid and connected to an associated end (37) of said interior duct (17), and a second collector (35) associated to the second fluid and connected to an associated end (39) of said exterior envelope (19), said collectors (33, 35) being separated in a sealed manner.

18. A heat exchanger according to claim 17, wherein said manifold block (31) has, in a transversal section, a substantially "eight" general form, of which first (31*a*) and second (31*b*) loops delimit respectively said first (33) and said second (35) collector, and of which portion (31*c*), common to said two loops (31*a*, 31*b*), has an opening for the passage of one associated end (37, 39).

19. A heat exchanger according to claim 16, comprising at least one introduction manifold block (31) and at least one evacuation manifold block (31) of fluid, said manifold blocks (31) comprising respectively a single collector (33) connected to an associated end (37) of said interior duct (17) for the introduction and the evacuation of the first fluid.

20. A heat exchanger according to claim 16, characterized in that associated ends (37) of said interior duct (17) protrude on either side of said exterior envelope (19).

21. A heat exchange unit according to claim 9, wherein said plurality of first longitudinal internal channels (21) of said interior duct (17) are substantially cylindrical.

* * * * *